United States Patent [19]

Seidler

[11] Patent Number: 4,930,397

[45] Date of Patent: Jun. 5, 1990

[54] DEVICE FOR COMPENSATING THE RECOIL ENERGY OF SMALL ARMS

[76] Inventor: Heribert Seidler, Heiligenstadterstrasse 67, A-1190 Vienna, Austria

[21] Appl. No.: 371,603

[22] Filed: Jun. 26, 1989

[30] Foreign Application Priority Data

Jun. 24, 1988 [AT] Austria ..... 1645/881

[51] Int. Cl.[5] ..... F41A 21/36

[52] U.S. Cl. ..... 89/14.3

[58] Field of Search ..... 89/14.3, 14.2, 14.4

[56] References Cited

U.S. PATENT DOCUMENTS

| | | | |
|---|---|---|---|
| 430,214 | 6/1890 | Maxim | 89/14.3 |
| 735,131 | 8/1903 | McClean | 89/14.3 X |
| 885,166 | 4/1908 | Mason | 89/14.3 X |
| 1,195,307 | 8/1916 | Wheatley | 89/14.3 X |
| 2,139,691 | 12/1938 | Michal, Jr. | 89/14.3 |
| 2,581,395 | 1/1952 | Elfstrom | 89/14.3 X |
| 2,935,000 | 5/1960 | Mowrey | 89/14.3 |
| 4,058,050 | 11/1977 | Brouthers | 89/14.3 |
| 4,207,799 | 6/1980 | Tocco | 89/14.3 |
| 4,479,418 | 10/1984 | Berella | 89/14.4 |
| 4,534,264 | 8/1985 | Tarnoff et al. | 89/14.3 |
| 4,691,614 | 10/1987 | Leffel | 89/14.3 |
| 4,715,140 | 12/1987 | Rosenwald | 89/14.3 X |

FOREIGN PATENT DOCUMENTS

| | | | |
|---|---|---|---|
| 1953466 | 7/1970 | Fed. Rep. of Germany . | |
| 3427854 | 2/1986 | Fed. Rep. of Germany . | |
| 1474832 | 1/1966 | France . | |
| 1055954 | 11/1983 | U.S.S.R. | 89/14.3 |

*Primary Examiner*—Charles T. Jordan
*Assistant Examiner*—Michael J. Carone
*Attorney, Agent, or Firm*—Bierman and Muserlian

[57] ABSTRACT

A device for reducing the felt effects of recoil in firearms including at least a barrel and a frame, this assembly including a muzzle brake unattachedly disposed around the muzzle portion of a barrel wherein the barrel completely traverses the muzzle brake. The muzzle brake is provided with deflector surfaces for upwardly deflecting pressurized gases generated during the firing of a projectile. The gases are directed against the deflector surfaces through gas outlet openings formed in the portion of the barrel transversing the muzzle brake, these gas outlets aligning with the deflector surfaces. The device further includes a retention means for securely retaining the muzzle brake to the firearm frame in relation to the longitudinal axis of the barrel. Such a device allows for the use of the combustion gases for reducing the effect of recoil, while advantageously avoiding the problems associated with precision alignment of the muzzle brake and the barrel.

9 Claims, 3 Drawing Sheets

DEVICE FOR COMPENSATING THE RECOIL ENERGY OF SMALL ARMS

FIELD OF THE INVENTION

The present invention relates to a device which is capable of compensating for the recoil energy associated with the firing of small arms. More specifically, the invention relates to a device wherein a muzzle brake having at least one deflector for upwardly deflecting high pressure gases is fitted over the barrel of a firearm which has been supplied with gas outlets to supply gas to the deflectors, the muzzle brake being attached only to the frame, and not the barrel of the firearm.

DESCRIPTION OF THE PRIOR ART

The attachment of a muzzle brake to the muzzle end of a firearm in order to compensate for recoil energy is well known in the art. These muzzle brakes are positioned parallel to the barrel axis and supplied with slots which communicate with corresponding gas vent holes drilled in the firearm barrel when the device is properly fitted. In order to fit these muzzle brakes, the muzzle end of the barrel is threaded and the brake is screwed on until the slots of the muzzle brake, and the holes drilled in the barrel, align. A set screw is provided to prevent the muzzle brake from unscrewing under the forces of recoil. Also known, and as shown for example in West German Pat. No. 3,427,854, are muzzle brakes which are fit to extend past the muzzle end of the barrel, negating the need for gas ports in the barrel itself.

While the above-described devices allow for the reduction of muzzle blast which occurs when the high velocity gas generated during firing exits the barrel, they cannot compensate for recoil energy as the slots through which the gas is dissipated are small, therefore providing only a small deflector surface. Further, although a set screw is usually provided, muzzle brakes of this type often loosen due to the great forces which act upon them during firing. When this occurs, the slots no longer align with the gas discharge holes of the barrel, and thus, the effectiveness of the device is totally lost.

In addition to the above, as heretofore known muzzle brakes were designed to attach to the barrel, and the deflector surfaces thereof were arranged in front of the barrel muzzle, and as described in U.S. Pat. No. 4,715,140, a through-opening had to be provided in the device for the passage of the projectile. In order to insure that the gases are deflected upward, through the muzzle brake, the opening must approximate the inner diameter of the barrel. This requirement necessitates the precise alignment of the muzzle brake, as otherwise the projectile may contact the inner wall surface of the brake resulting in the deflection of the projectile at best, and at worst, damage to the muzzle brake and the barrel of the firearm.

Other devices of this type, which attach to the muzzle end of the barrel, include those designed to compensate for the rotational forces generated by the projectile as it travels through the rifling of the barrel. These rotational forces can transfer to the grip of the weapon. Devices such as these are designed with gas openings which are asymmetrical with respect to the barrel axis so that the gas outlet opening is greater on one side of the barrel than on the other and the unequal amount of the emerging gases causes an antitorque motion on the firearm. Such devices, however, do not counteract recoil and, due to their similar designs, suffer from all the disadvantages associated with muzzle brakes, as described above.

Recoil compensating devices which attach to the frame and loosely fit over the barrel are also known. These devices, however, only comprise a weight which fits over the barrel to attenuate the recoil. Such devices do not use gases to compensate for recoil, however, and the alignment between the barrel and the weight is therefore not critical. These devices are disadvantageous as a great amount of weight is required to counteract recoil, adversely affecting the balance of the firearm.

SUMMARY OF THE INVENTION

It is therefore an object of the invention to provide a recoil compensating device which employs discharge gases to reduce perceived recoil but does not attach directly to the barrel of the firearm, thus avoiding the problems associated with precision alignment.

The invention comprises a muzzle brake unattachedly disposed around the muzzle portion of the firearm barrel, said barrel completely traversing the muzzle brake. The muzzle brake is provided with deflector surfaces for upwardly deflecting pressurized gases generated during the firing of a projectile, these gases being directed against the deflector surfaces through a set of gas outlet openings formed in the barrel. The device further comprises a retention means for solidly retaining the muzzle brake to the firearm frame in relation to the longitudinal axis of the barrel.

The inventive design can be used on firearms wherein the axis of the barrel shifts during the firing cycle, as well as on firearms having fixed barrels. The large deflector surfaces of the invention insure adequate recoil compensation and barrel length is not limited by the device as it is not necessary to fit the muzzle brake at the forward end of the barrel. A further advantage of positioning the muzzle brake behind the muzzle end of the barrel is that the energy of the projectile is not reduced by the blast wave of gases exiting the muzzle.

The inventive design further achieves advantages in manufacturing as precision machining and alignment of the muzzle brake is not critical. The loosening of the muzzle brake is avoided as the brake is attached to the frame of the firearm, which does not move during the firing cycle, and not to the barrel. Further, as the compensator is only loosely positioned over the barrel, firearms in which the barrel is removable can be disassembled rapidly, without special tools.

These and other various objects and advantages of the present invention will become more fully apparent as the following description is read in conjunction with the accompanying drawings.

DETAILED DESCRIPTION OF THE INVENTION

Figure 1:
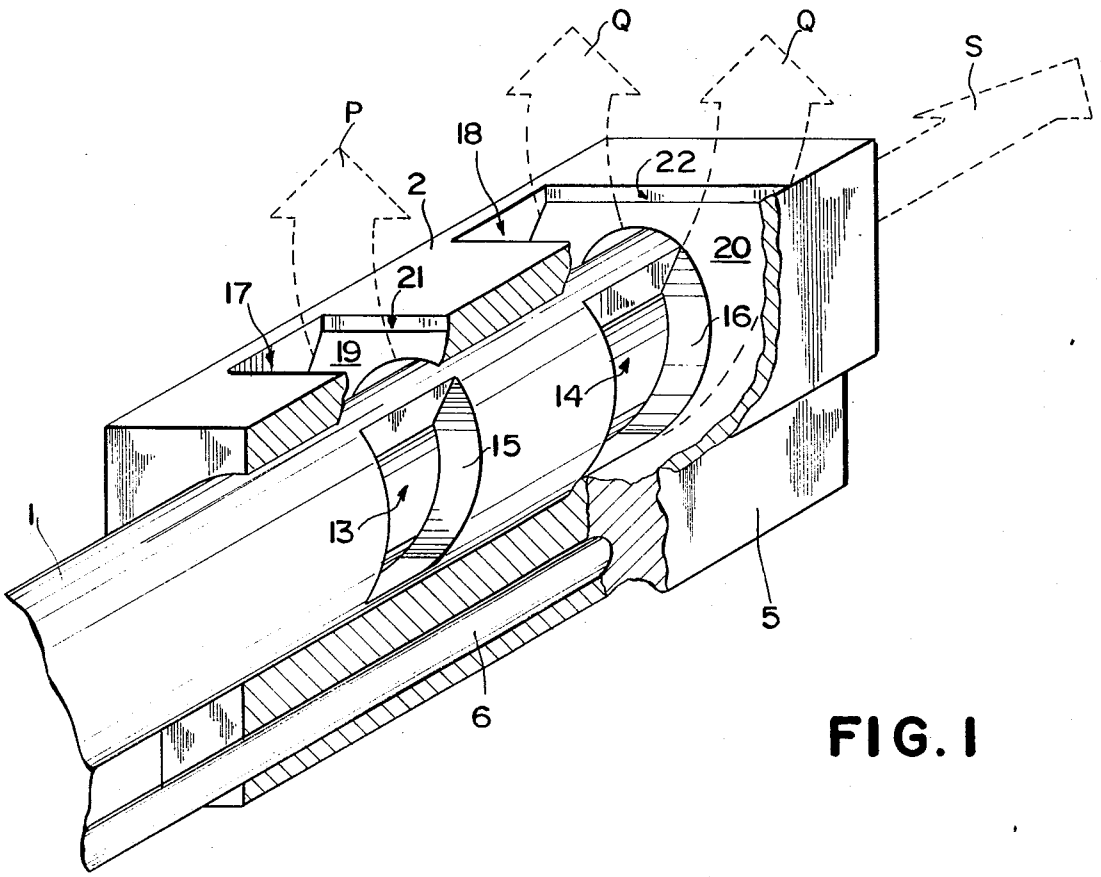
FIG. 1 illustrates the muzzle brake, partially in axial section, and with the side wall partially broken away.
Figure 2:
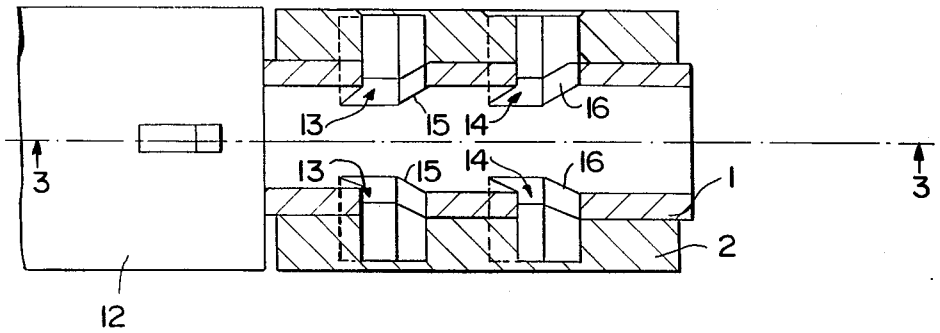
FIG. 2 is a horizontal section along the center axis through the muzzle brake and the corresponding barrel portion.
Figure 4:
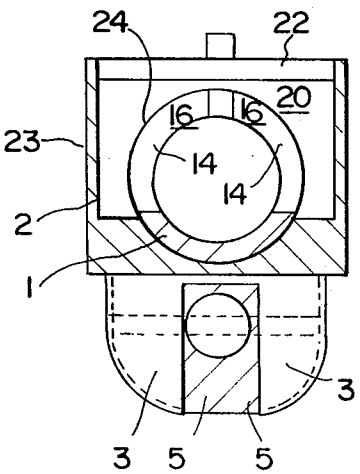
FIG. 4 illustrates a section taken along the line IV—IV of FIG. 3.
Figure 3:
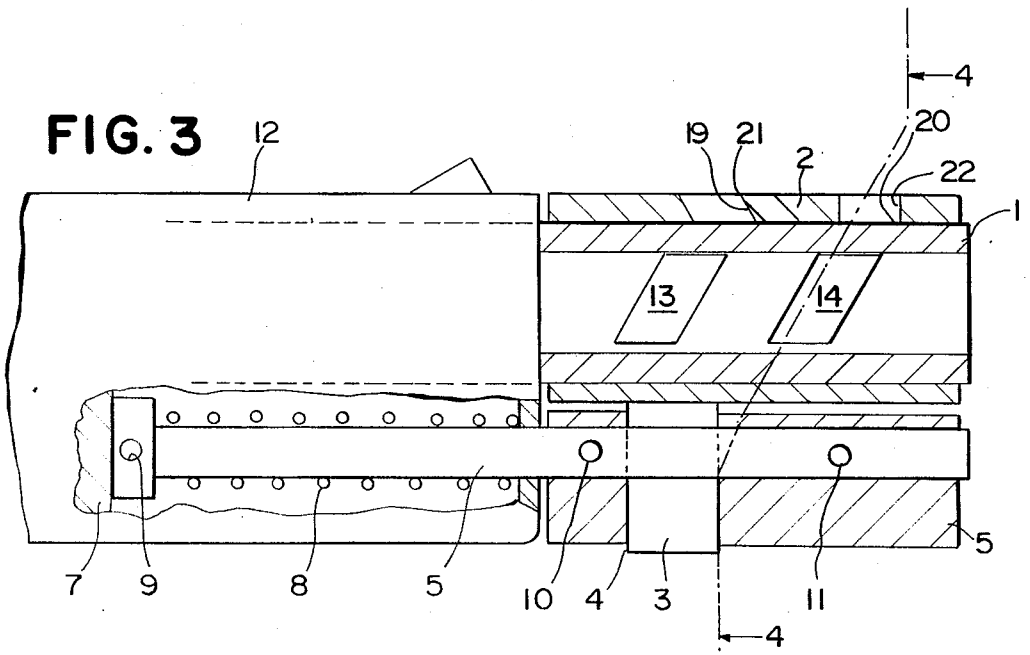
FIG. 3 is a section taken along the line III—III of FIG. 2.

The recoil compensating device of FIGS. 1 to 4 includes a muzzle brake 2 unattachedly disposed around the muzzle portion of the barrel 1 of the firearm. The lower portion of the muzzle brake is provided with a retaining shoe 3 designed as a downwardly directed fork. The fork prongs engage holding slots 4 formed in a stationary frame element 5. The frame element 5 is attached to a support rod 6 by pins 10, 11. The support rod 6 preferably also acts as a spring guide for the recoil spring 8 of the firearm. The support rod 6 securely connects the frame element 5 to the firearm receiver 7. The support rod 6 is secured to the receiver 7 by a pin 9. Reference numeral 12 designates the breechblock of the firearm.

The barrel 1 is provided with lateral, outwardly directed gas outlet openings 13, 14, the leading edges 15, 16 of which preferably extend slantingly forward and upward. The outer wall of the barrel 24 and the side walls of the muzzle brake 23 form chambers 17, 18, corresponding in position to the gas outlet openings 13, 14. These chambers 17, 18 are open only toward the top. The front walls of the chambers 17, 18 act as deflector surfaces 19, 20 and are inclined in the same direction as the leading edges 15, 16 of the gas outlet openings 13, 14. Preferably, the upper area of the deflector surfaces 19, 20 slant rearwardly toward the top to further deflect gas flow. Although the figures illustrate a two chamber compensator, the number of chambers can be selected arbitrarily.

Figure 5:
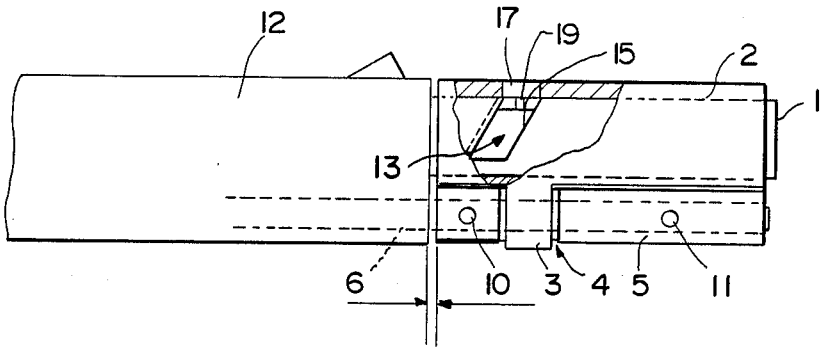
FIGS. 5 to 7 show the path of travel of the device in firearms wherein the rear end of the barrel drops during the cycling of the firearm action, with the area of the muzzle brake provided with a chamber being shown in partial sectional view.
Figure 6:
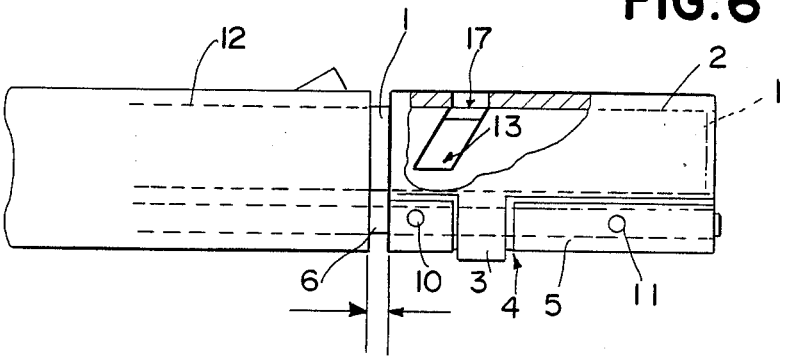
Figure 7:
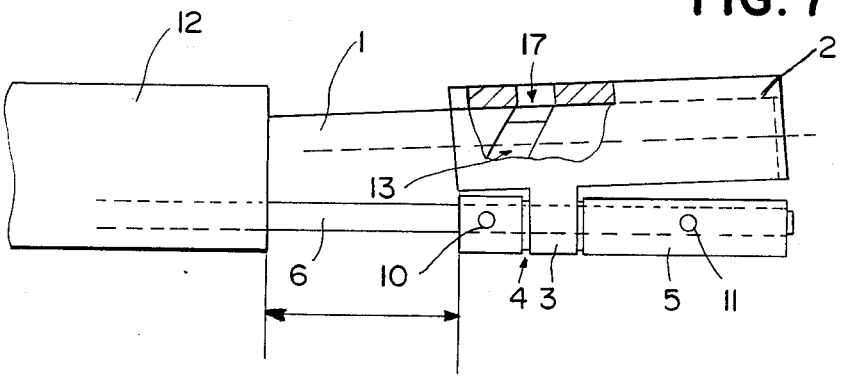

FIG. 5 illustrates the front deflector surface 19 of the chamber 17 as slightly offset rearwardly with respect to the leading edge 15 of the gas outlet opening 13 of the barrel 1, to a degree which corresponds to the path traveled by the barrel, as occurs in firearms wherein the rear end of the barrel 1 drops during the cycling of the firearm action. FIGS. 5 to 7 illustrate this travel, as occurs in such firearms wherein the barrel initially retracts by a set amount, and subsequently tilts, during cycling. FIG. 5 shows the position of the individual parts prior to the firing of the shot. FIG. 6 shows the position immediately after firing the shot, and FIG. 7 illustrates the position of the parts when the action is at its rearwardmost position, with the breech open, and with the rear end of the barrel 1 tilting downward. In correspondence with this downward tilting, the muzzle brake 2 travels upwards via its fork 3 in the holding slot 4 without impairing the movement of the barrel 1 in any way. During the closing of the breech, the movements, as illustrated in FIGS. 5 to 7, occur in the opposite direction.

Upon firing a shot, the projectile initially accelerates through the barrel 1 until passing gas outlet opening 13 from which a first portion of the combustion gas escapes and is deflected along the deflector surfaces 15 and 19 as shown in broken lines by the arrow P. A similar gas discharge occurs via gas outlet opening 14 as shown by arrow Q. The gas is deflected upwardly and thus compensates recoil and the impact energy of the gas upon the atmosphere. The remaining propellant gas emerges from the barrel at its forward end as indicated by arrow S.

While the inventive design is applicable for all types of small arms, both those with fixed barrels and those wherein the barrel drops during cycling of the action, the deflection of the gases is attained in the same manner. However, in firearms with rigid barrels, it should be noted that no relative motion between the barrel and muzzle brake occurs and therefore, the respective surfaces of the gas outlet openings and the chambers must always be aligned adjacent to each other.

While preferred embodiments have been shown and described, various modifications and substitutions may be made thereto without departing from the spirit and scope of the invention. Accordingly, it will be understood that the present invention is not to be limited except by the character of the claims appended hereto.

I claim:

1. A device for reducing the felt effects of recoil in a firearm, said firearm including a barrel and receiver, said device comprising;

a muzzle brake unattachedly disposed around the muzzle portion of said barrel, said barrel completely traversing said muzzle brake, said muzzle brake being provided with deflector surfaces for upwardly deflecting pressurized gases generated during the firing of a projectile, said gases being directed against said deflector surface through gas outlet openings provided in the portion of said barrel traversing said muzzle brake, said gas outlet openings aligning with the deflector surfaces; and a retention means for securely retaining said muzzle brake to said firearm receiver in a fixed relation to the longitudinal axis of said barrel.

2. The device of claim 1 wherein side walls of said muzzle brake and the outer wall of said barrel form laterally closed chambers on both sides of said barrel, said chambers being open at the top end thereof, wherein said chambers have forward peripheral walls corresponding to the leading edges of said gas outlet openings formed in said barrel.

3. The device of claim 2 wherein said leading edges of said gas outlet openings slant forward and upward.

4. The device of claim 3 wherein said forward peripheral walls of said chambers extend upwardly and slantingly rearwardly.

5. The device of claim 1 wherein said retaining means comprises downwardly directed forks formed as an integral part of said muzzle brake on the bottom portion thereof, said forks engaging a support rod connected to the firearm receiver.

6. The device of claim 5 wherein said support rod also acts as a guide for a recoil spring of said firearm.

7. The device of claim 5 wherein said retaining means is adapted to maintain the muzzle brake parallel to the longitudinal axis of said barrel in firearms wherein said axis shifts during a firing cycle.

8. The device of claim 5 wherein a front portion of said support rod carries a frame element having a greater diameter than said support rod, two holding slots extending perpendicular to the barrel axis being formed within said frame element, said forks of said retaining means engaging said holding slots.

9. The device of claim 7 wherein the forward peripheral walls of the chambers are offset rearwardly with respect to the leading edges of said gas outlet opening during said axis shift of said barrel.

* * * * *